US005490894A

United States Patent [19]

Matsuhisa et al.

[11] Patent Number: 5,490,894

[45] Date of Patent: Feb. 13, 1996

[54] CLEANING METHOD USING AZEOTROPIC MIXTURES OF PERFLUORO-N-HEXANE WITH DIISOPROPYL ETHER OR ISOHEXANE AND CLEANING APPARATUS USING SAME

[75] Inventors: Hirohide Matsuhisa, Yokohama; Satoko Midorikawa, Machida; Sumire Mima, Tokyo, all of Japan

[73] Assignee: Canon Kabushiki Kaisha, Tokyo, Japan

[21] Appl. No.: 418,436

[22] Filed: Apr. 7, 1995

Related U.S. Application Data

[62] Division of Ser. No. 183,807, Jan. 21, 1994, Pat. No. 5,431,837.

[30] Foreign Application Priority Data

| | | | |
|---|---|---|---|
| Jan. 22, 1993 | [JP] | Japan | 5-026035 |
| Jun. 4, 1993 | [JP] | Japan | 5-158057 |
| Jun. 10, 1993 | [JP] | Japan | 5-163788 |
| Dec. 10, 1993 | [JP] | Japan | 5-340964 |

[51] Int. Cl.[6] ..... B08B 3/08; B08B 5/00; B05C 3/02; B05C 9/12

[52] U.S. Cl. ..... 134/30; 134/31; 134/40; 134/42; 134/76; 134/105

[58] Field of Search ..... 252/67, 68, 69, 252/162, 172, 364, DIG. 9, 171, 170; 203/67; 134/31, 30, 40, 42, 76, 105

[56] References Cited

U.S. PATENT DOCUMENTS

| | | | |
|---|---|---|---|
| 4,647,689 | 3/1987 | Micinski | 560/174 |
| 4,879,407 | 11/1989 | Amiet | 560/227 |
| 4,971,716 | 11/1990 | Batt et al. | 252/171 |
| 5,023,010 | 6/1991 | Merchant | 252/171 |
| 5,166,182 | 11/1992 | Blanpied | 521/131 R X |
| 5,225,099 | 7/1993 | Basu et al. . | |
| 5,259,983 | 11/1993 | VanDerPuy et al. | 252/171 |
| 5,266,231 | 11/1993 | Robek et al. | 252/171 |
| 5,266,232 | 11/1993 | Robek et al. | 252/171 |
| 5,286,759 | 2/1994 | Smits et al. | 521/131 |
| 5,395,540 | 3/1995 | Gisser et al. | 252/67 |
| 5,403,514 | 4/1995 | Matsuhisa et al. | 134/40 X |

FOREIGN PATENT DOCUMENTS

| | | |
|---|---|---|
| 0431458 | 6/1991 | European Pat. Off. . |
| 0443911 | 8/1991 | European Pat. Off. . |
| 0465037 | 1/1992 | European Pat. Off. . |
| 5214324 | 8/1993 | Japan . |
| 5293303 | 11/1993 | Japan . |
| WO9323519 | 11/1993 | WIPO . |
| WO9323518 | 11/1993 | WIPO . |
| WO9322416 | 11/1993 | WIPO . |

OTHER PUBLICATIONS

Catalog Handbook Of Fine Chemcials, Aldrich Chemical Company, Inc., 1990, pp. 631, 901, and 1022. month not known.

Hicks et al., "Upper Critical Solution Temperatures of Hydrocarbon & Fluorocarbon Mixtures", Aust. J. Chem., 31 (1978), 19–25. month not known.

Stiles et al., "Physical Properties of Perfluoro–n–hexane and Perfluror–2–methylpentane", J. Amer. Chem. Soc., 74 (Aug. 1952), 3771–3.

*Primary Examiner*—Douglas J. McGinty

*Attorney, Agent, or Firm*—Fitzpatrick, Cella, Harper & Scinto

[57] ABSTRACT

Disclosed herein is a mixed solvent composition including perfluorohexane and isohexane or diisopropyl ether.

18 Claims, 5 Drawing Sheets

CLEANING METHOD USING AZEOTROPIC MIXTURES OF PERFLUORO-N-HEXANE WITH DIISOPROPYL ETHER OR ISOHEXANE AND CLEANING APPARATUS USING SAME

This application is a division of application Ser. No. 08/183,807 filed Jan. 21, 1994, now U.S. Pat. No. 5,431,837.

BACKGROUND OF THE INVENTION

1. Field of the Invention

The present invention relates to a novel mixed solvent composition belonging to chlorine-free organic solvents, and a method of cleaning various instrument parts using such a solvent and a cleaning apparatus for performing the method.

2. Related Background Art

Chlorofluorocarbons (hereinafter abbreviated as "CFC") have heretofore been used in many industrial fields because most of them are low in toxicity, incombustible and chemically safe, and various kinds of flons different in boiling point are available. Among these, flon 113 has been used as a degreasing solvent or vapor cleaning and drying solvent for many plastic materials, a part of rubber materials and various composite materials, making good use of specific chemical properties inherent in the solvent.

Also, trichloroethane has been used as a replacement for 1,1,2-trichloroethylene and 1,1,2,2-tetrachloroethylene, which have hitherto been used as degreasing and cleaning solvents for metal surfaces after metal working, but are noxious to the human body and are the cause of pollution of underground water.

In recent years, however, ozone holes by which global environment is made worse have been discovered, and the main cause of the ozone hole being formed has been proved to be attributable to organochlorine compounds such as CFC.

For example, flon 113, which is chemically stable, lasts long in the troposphere, diffuses to the stratosphere and is photochemically decomposed by rays of the sum there, thereby generating chlorine radicals which then combine with ozone so as to destroy the ozonosphere.

Therefore, after this, the organochlorine compounds including flons have a tendency for their use to be internationally limited and finally completely prohibited. Among these, flon 113 as described above is high in ozone depletion potential. Thus, it is desirable to replace flon 113, and there is a schedule for sharpely reducing its use. Trichloroethane is also scheduled to be unsparingly reduced for the same reason as described above.

SUMMARY OF THE INVENTION

It is thus an object of the present invention to provide a novel nonflammable, azeotropic mixed solvent composition replaceable for flon 113 and trichloroethane which are organochlorine solvents routinely used, and a cleaning method and a cleaning apparatus making use of such a solvent.

To achieve such an object, in the first aspect of the present invention, there is provided a mixed solvent composition comprising perfluorohexane and isohexane or diisopropyl ether.

In the second aspect of the present invention, there is provided a mixed solvent composition comprising 70 to 85 by weight of perfluorohexane and 15 to 30% by weight of isohexane.

In the third aspect of the present invention, there is provided a mixed solvent composition comprising 70 to 85% by weight of perfluorohexane and 15 to 30% by weight of diisopropyl ether.

In the fourth aspect of the present invention, there is provided a mixed solvent composition comprising perfluorohexane, isohexane and ethyl trifluoroacetate.

In the fifth aspect of the present invention, there is provided a cleaning method including an article-cleaning step with a solvent, and optionally a purging or rinsing step with a solvent, and a cleaning and drying step with solvent vapor, wherein the mixed solvent composition according to any one of the first through the fourth aspects is applied to any one of the steps.

In the sixth aspect of the present invention, there is provided a cleaning apparatus including at least one cleaning tank, and optionally a purging or rinsing tank and a vapor cleaning and drying tank, wherein the mixed solvent composition according to any one of the first through fourth aspects is fed to any one of the tanks.

DESCRIPTION OF THE PREFERRED EMBODIMENTS

Figure 1:
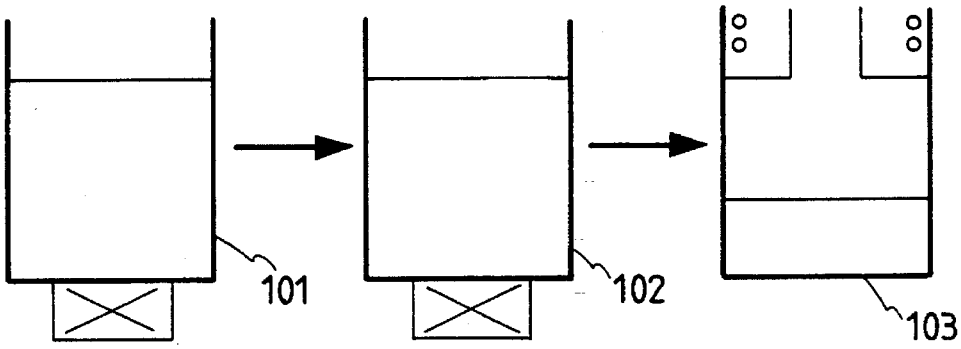
FIGS. 1 through 3 schematically illustrate embodiments according to the cleaning method of the present invention.

The present invention will hereinafter be described in detail by preferred embodiments.

A mixed solvent composition according to an embodiment of the present invention comprises perfluorohexane and isohexane. In particular, it may preferably include 70 to 85% by weight of perfluorohexane and 15 to 30% by weight of isohexane. Also, a mixed solvent composition according to another embodiment of the present invention comprises perfluorohexane and diisopropyl ether. In particular, it may preferably include 70 to 85% by weight of perfluorohexane and 15 to 30% by weight of diisopropyl ether.

With respect to the azeotropic points of such mixed solvent compositions according to the present invention, the former solvent composition including 70 to 85% by weight of perfluorohexane and 15 to 30% by weight of isohexane has an azeotropic point ranging from 44° to 48° C., while the latter solvent composition including 70 to 85% by weight of perfluorohexane and 15 to 30% by weight of diisopropyl ether has an azeotropic point ranging from 47° to 51° C.

More specifically, the boiling points of the individual components are 58° to 60° C. for perfluorohexane, 62° C. for isohexane and 60° C. for diisopropyl ether. On the other hand, the azeotropic points of the mixed solvent compositions according to the present invention are lower than those temperatures, and the compositions of the present invention hence show azeotropic behavior corresponding to the minimum boiling point.

Perfluorohexane contains small amounts of impurities such as perfluoropentane, perfluoroheptane and perfluorocyclohexane in addition to many isomers. However, in general, perfluoro-n-hexane having a purity of at least 70% by weight may preferably be used in the present invention.

Specific examples of perfluorohexane satisfying such conditions may include "Fluorinert FC-72" (trade name, product of Sumitomo 3M Limited), "Perfluorocarbon Coolant FX3250" (trade name, product of Sumitomo 3M Limited), "Inert Fluid PF-5060" (trade name, product of Sumitomo 3M Limited), "F Lead KPF-61 (trade name, product of Kanto Denka Kogyo Co., Ltd.) and "Perfluorohexane" (trade name, product of PCR Company).

Isohexane (2-methylpentane) used in the composition according to the present invention also contains small amounts of impurities such as 3-methylpentane and cycloalkanes. However, it may be used so long as it is high in isohexane content and the amount of n-paraffins and cycloparaffins contained as impurities is less than 30% by weight. In general, isohexane (2-methylpentane) having a purity of at least 70% by weight may preferably be used.

A mixed solvent composition according to a further embodiment of the present invention comprises perfluorohexane, ethyl trifluoroacetate and isohexane.

The azeotropic point of such a mixed solvent composition falls within a range of from 42° to 46° C. The proportions of the individual components in this composition are 60 to 70% by weight for perfluorohexane, 15 to 21% by weight for ethyl trifluoroacetate and 14 to 20% by weight for isohexane.

The boiling points of the individual components are 58° to 60° C. for perfluorohexane, 60° to 62° C. for ethyl trifluoroacetate and 62° C. for isohexane. The azeotropic point of the mixed solvent composition is lower than any of those boiling points, and the composition of the present invention hence shows azeotropic behavior corresponding the minimum boiling point.

The mixed solvent compositions according to the present invention, which are composed respectively of the above-described components and compositions, are useful in cleaning various kinds of articles.

The cleaning method according to the present invention features that the mixed solvent composition of the present invention being used at least once in any one of usual cleaning steps.

A routine cleaning process includes, for example, a cleaning step making use of at least one cleaning tank, a purging or rinsing step making use of at least one purging or rinsing tank subsequent to the cleaning tank and a vapor cleaning and drying step making use of at least one vapor cleaning (boiling) and drying tank. In the cleaning method according to the present invention, the mixed solvent composition is preferably used at least once in any one of these steps. It is particularly preferable to use the mixed solvent composition of this invention in the vapor cleaning and drying step of the above-described steps. It goes without saying that the present invention is not limited to such a method.

In the cleaning method according to the present invention, any of the known cleaning solvents may be used so long as the mixed solvent composition of this invention is used at least once. The known cleaning solvents used in the present invention may be optionally chosen for their suitable use according to the kinds of articles to be cleaned.

More specifically, examples of petroleum cleaning solvents may include the following commercially-available solvents:

Actrel 1130L, 1140L, 1178L, 1111L, 1113L, 3307L, 3338L, 3356L and 3357L;

Solvesso 100, 150 and 200 (the foregoing are products of Exxon Chemical Japan Ltd. );

Normal Paraffin SL, M and H;

Isosol 200, 300 and 400;

Naphthesol L, M and H

Hi-Sol E and F (the foregoing are products of Nippon Petrochemicals Co., Ltd. );

Clean Sol G, Cleansol, Mineral Spirit A (products of Nippon Oil Co., Ltd. );

Axarel 6100 and 9100 (products of Du Pont-Mitsui Fluorochemicals Co., Ltd. );

Cactus Solvent T95S, X90Y, P50 and N-10 (products of Nikko Sekiyu Kagaku K.K.);

Kasei Cleaner (product of Mitsubishi Industries Limited) , N-methylpyrrolidone (product of BASF AG);

Technocare FRW-14, 15, 16, 17, 18 and 19 (products of Toshiba Corporation);

Solfine (product of Tokuyama Petrochemical Co., Ltd. );

IPA-EL (product of Nippon Petrochemicals Co., Ltd. ), IPA-SE (product of Tokuyama Soda Co., Ltd. );

Mixed solvent composition of Inert Fluid PF-5060 (product of Sumitomo 3M Limited)/isohexane (product of Tokyo Kasei Kogyo Co., Ltd.) at a ratio of 78.3/21.7% by weight; and Mixed solvent composition of Inert Fluid PF-5060 (product of Sumitomo 3M Limited)/diisopropyl ether (product of Kishida Chemical Co., Ltd.) at a ratio of 81.2/18.2% by weight.

Specific examples of aqueous cleaning solvents used in the cleaning step may include:

DK Beclear CW-4310, 5524, 6920 and 7425 (products of Dai-ich Kogyo Seiyaku Co., Ltd. );

Semiclean M, L.G.L and PC-1 (products of Yokohama Yushi K.K. );

Clean Through LC-820 and 750L (products of Kao Corporation);

Detergent 50 and 1000 (products of NEOS Company Limited );

Pine Alpha ST-100S (product of Arakawa Chemical Industries, Ltd. );

Bioseven AL (product of Beritus Company);

Banrise D20-S (product of Tokiwa Chemical Industry Co., Ltd. ); and

Technocare FRS-1, 2 and 3 (products of Toshiba Corporation). However, the cleaning solvents are not limited to the above solvents.

If one of the known cleaning solvents mentioned above is used in the cleaning step in the cleaning method according to the present invention, the mixed solvent composition of the present invention is used in any one of the subsequent steps. For example, a method in which one of the known solvents is used in the cleaning step, and if the mixed solvent composition of this invention is used in the vapor cleaning and drying step it may be mentioned as a preferred embodiment.

In this case, as a purging or rinsing agent used in the purging or rinsing step between the above two steps, any solvent composition may be used so long as it is compatible with both solvents of the various cleaning solvents used in the cleaning step and the mixed solvent compositions of the present invention used in the vapor cleaning and drying step subsequent to the purging or rinsing step.

In general, as the purging or rinsing agent, there may be used the same solvent as the cleaning solvent used in the cleaning step preceding this step or as the vapor cleaning and drying solvent used in a vapor cleaning (boiling) and drying tank for the vapor cleaning and drying step.

In the cleaning method according to the present invention, as described above, the mixed solvent compositions according to the present invention are preferably used at least in the vapor cleaning and drying step. However, they may be used in all the three steps of the cleaning step, the purging or rinsing step and the vapor cleaning and drying step, or in any two of these steps, or only in any one of these steps.

According to vapor cleaning and drying, a stain after drying is generally does not occur on the surface of an article cleaned as compared with other drying techniques such as drying by heating and vacuum drying, and a finish high in cleanliness can be achieved.

As vapor cleaning and drying solvents used in the vapor cleaning and drying step, there have heretofore often been chlorinated solvents such as flon 113, trichloroethane, 1,1,2-trichloroethylene, 1,1,2,2-tetrachloroethylene and methylene chloride.

These known solvents are ozone-depleting substances and/or noxious substances to the human body. However, isopropyl alcohol (hereinafter abbreviated as "IPA") and the like have been proposed as replacements for these solvents. However, IPA has a low flash point (Fp= 11.7° C.) and hence involves a problem that its use is difficult from the viewpoint of safety.

Further, it has been proposed to use only a perfluorocarbon compound as a vapor cleaning and drying solvent. However, perfluorocarbons present a problem in that a stain after drying tends to occur due to its low compatibility with various kinds of solvents.

In view of the foregoing circumstances, the cleaning method in which the mixed solvent compositions according to the present invention are used as vapor cleaning and drying solvents used in the vapor cleaning (boiling) and drying tank for the vapor cleaning and drying step is most preferred. More specifically, when the vapor cleaning and drying step is designed in the above-described manner, a cleaning operation can be conducted in a nonflammable environment high in safety. In addition, the compatibility with other solvents is superior to the case where the routine perfluorocarbon is used alone, and a range of choice of a cleaning solvent can hence be widened, so that there is a merit that the process can be shortened.

In a cleaning process in which oily smear is mainly removed, for example, a degreasing process of a metalworking oil, all of a cleaning solvent, a purging or rinsing solvent, and a vapor cleaning and drying solvent may be composed of the mixed solvent compositions according to the present invention.

To the cleaning step and purging or rinsing step in the method of the present invention, may also be applied any external force such as heating, ultrasonic vibration, swinging, showering, brushing, scrubbing, jetting and/or boiling. In the final tank in the purging or rinsing step, it is, however, desirable to control a liquid temperature at a point at least lower than the azeotropic point of the mixed solvent composition according to the present invention in order to raise the efficiency of the subsequent vapor cleaning.

In the present invention, the mixed solvent composition of this invention is slowly vaporized in a vapor cleaning (boiling) and drying tank equipped with a condenser in the vapor cleaning and drying step and condensed on the surface of an article to be cleaned so as to completely wash out the purging or rinsing solvent used in the preceding purging or rinsing step. Thereafter, the treated article is pulled up at such a slow speed that a vapor line is not disturbed to completely dry it.

Figure 2:
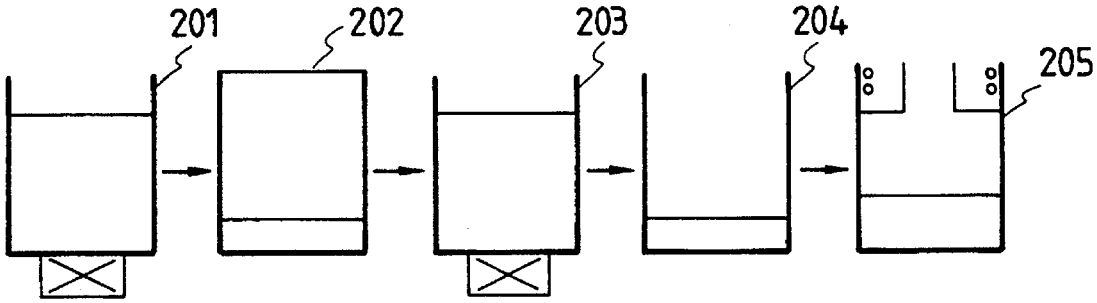
Figure 3:
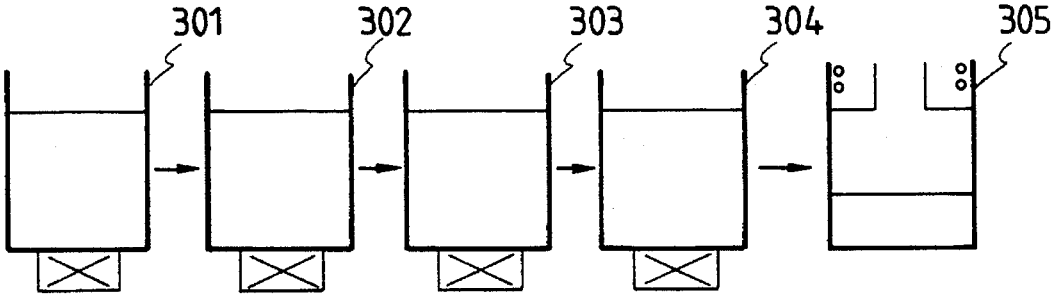

Embodiments of the cleaning method according to the present invention are shown in FIGS. 1 through 3.

FIG. 1 is a case in which the mixed solvent composition of this invention is used in all tanks of a cleaning tank 101, a purging or rinsing tank 102 and a vapor cleaning (boiling) and drying tank 103. FIG. 2 is a case in which a petroleum cleaning solvent is used in cleaning tanks 201, 202, and the mixed solvent composition of this invention is used in purging or rinsing tanks 203, 204 and a vapor cleaning (boiling) and drying tank 205. FIG. 3 is a case in which an aqueous cleaning solvent is used in a cleaning tank 301, and the mixed solvent composition of this invention is used in purging or rinsing tanks 302, 303, 304 and a vapor cleaning (boiling) and drying tank 305.

A cleaning apparatus to which the cleaning method of the present invention as described above is applied features the mixed solvent composition of this invention being used at least once. No particular limitation is imposed on its construction so long as the apparatus meets the cleaning method of the present invention as described above. However, since the mixed solvent compositions according to the present invention are high in vapor pressure, it is preferable to control the freeboard ratio of the vapor cleaning (boiling) and drying tank to at least 1 from the viewpoint of the prevention of escape of the composition by evaporation.

Figure 4:
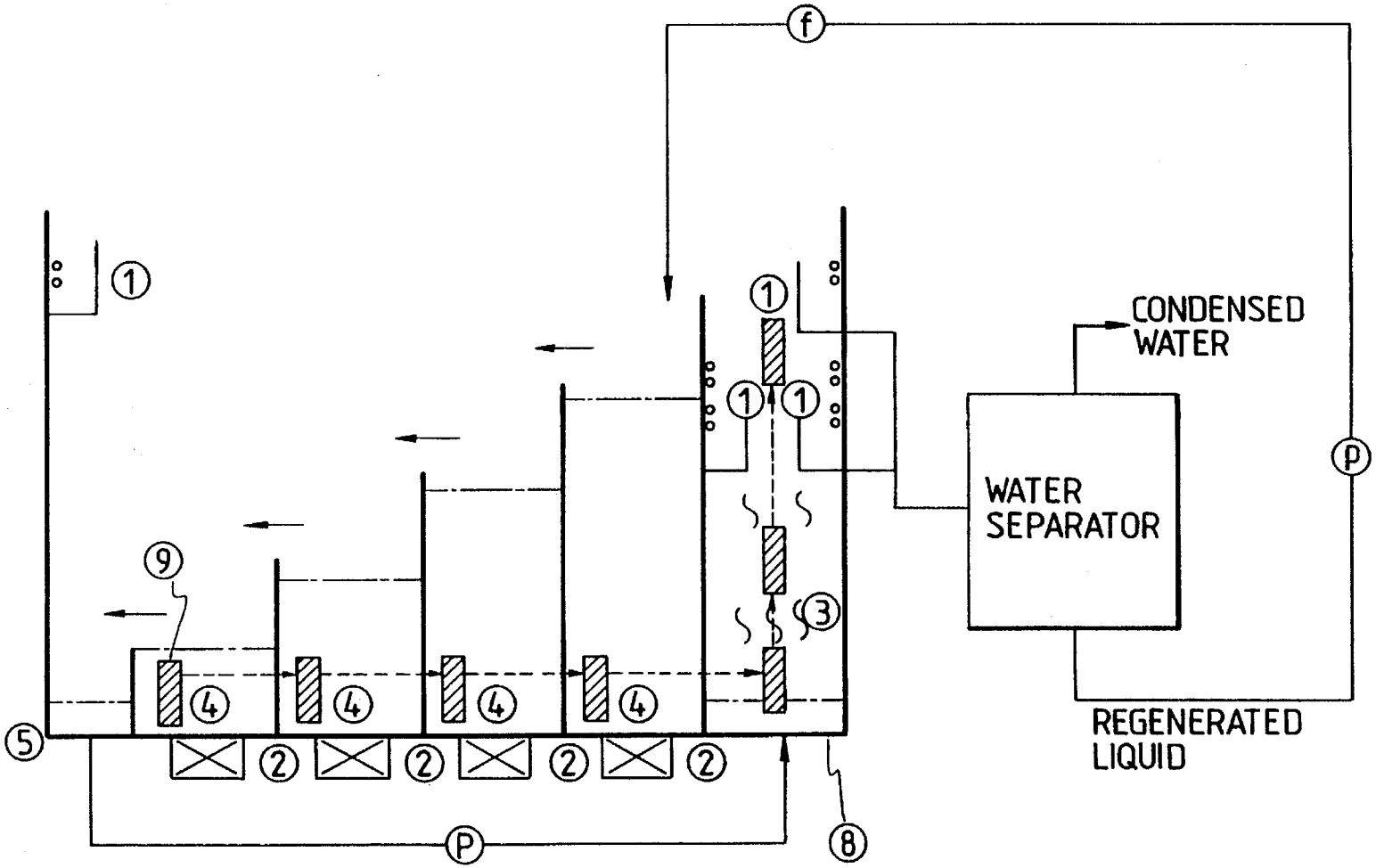
FIGS. 4 through 6 are schematic block diagrams illustrating embodiments according to the cleaning apparatus of the present invention.
Figure 5:
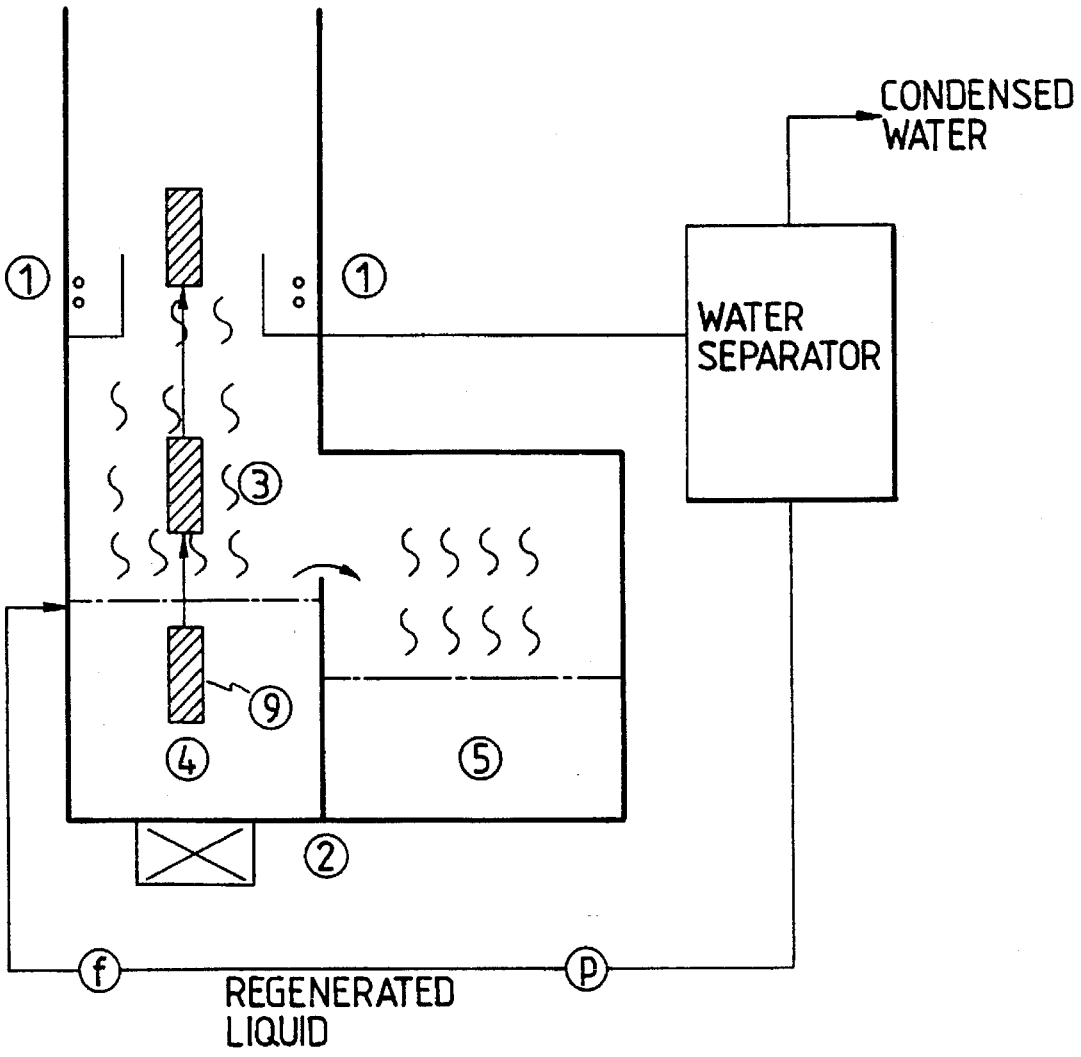
Figure 6:
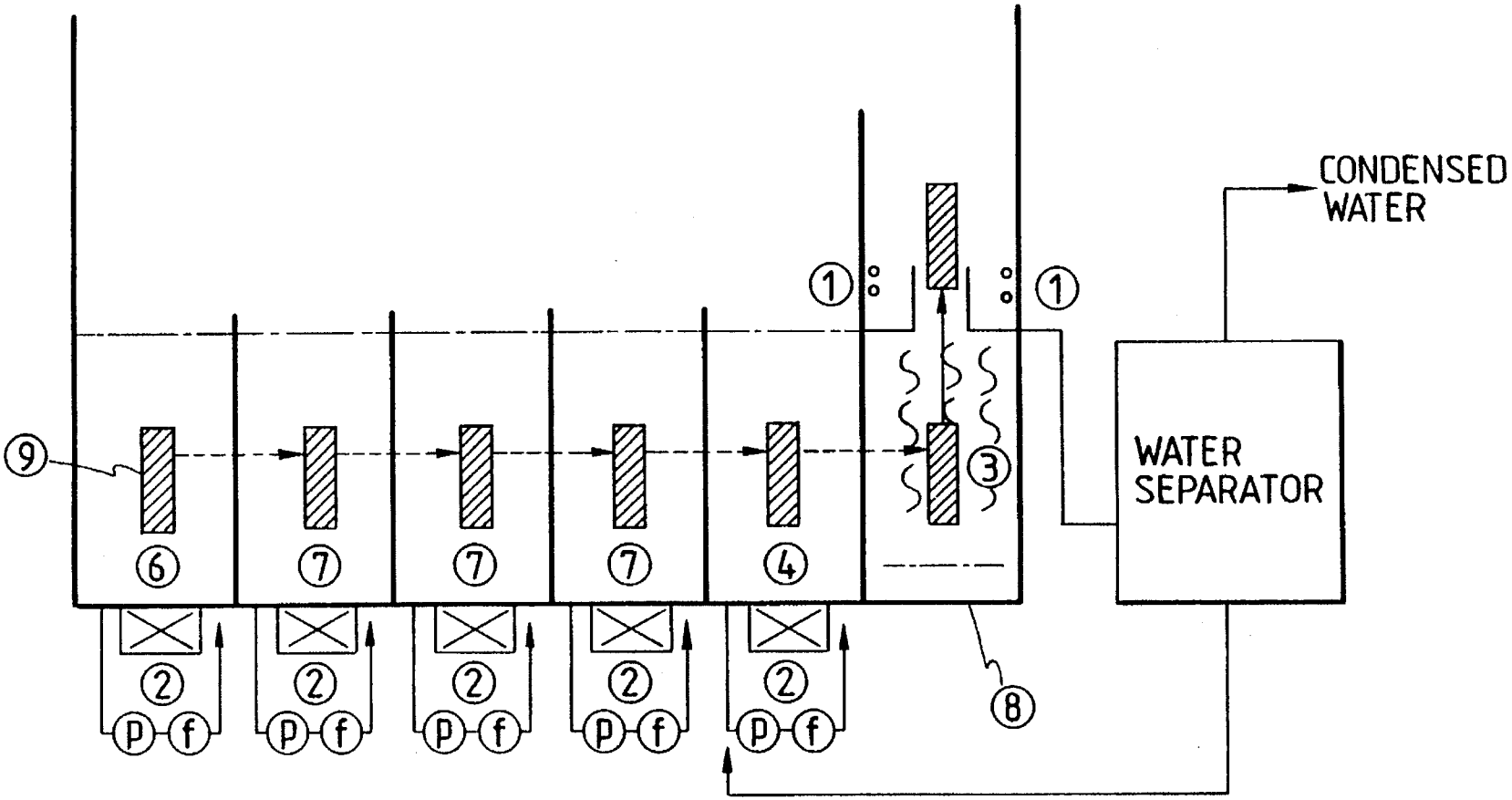

More specifically, apparatuses of such constructions as illustrated in FIGS. 4 through 6 by way of example are preferred.

The apparatus illustrated in FIG. 4 is an embodiment of a commonly-used cleaning machine of successive overflow tank type. Referring now to the drawing, the cleaning machine includes a plurality of ultrasonic cleaning tanks 2 which differ in height level from each other in order and provided in lateral arrangement. In the respective ultrasonic cleaning tanks 2, are filled with articles 9 to be cleaned, which are successively transferred in a right direction on the drawing. When the mixed solvent composition 4 of the present invention fed from a feed pump P is introduced into the tank highest in level, the liquid successively overflows into the tanks lower in level, whereby the articles 9 immersed in the respective tanks 2 are subjected to ultrasonic cleaning.

A mixed solvent composition 5 contaminated by the cleaning treatment finally overflows into the tank positioned on the leftmost side. The contaminated mixed solvent composition 5 is then sent by a feed pump P to a vapor cleaning (boiling) and drying tank 8 located on the right-hand side on the drawing. The articles 9 cleaned with the solvent and successively transferred in the right direction on the drawing are cleaned and dried with vapor 3 generated from the contaminated mixed solvent composition 5 by vaporization and then taken out of the line.

After the vapor 3 is condensed by a condenser 1 to liquefy, water contained in the liquefied composition is separated by a water separator. The regenerated liquid from which condensed water is removed is sent by the pump P through a filter f for removing dust and then fed again to the highest ultrasonic cleaning tank 2, thereby repeating this cycle.

FIG. 5 illustrates an embodiment of a vapor drying apparatus (vertical simple cleaning machine). As with the embodiment of FIG. 4, the mixed solvent composition 4 according to the present invention is sent by a pump P through a filter f to an ultrasonic cleaning tank 2 containing an article 9 to be cleaned, thereby subjecting the article 9 contained in the tank to ultrasonic cleaning. A mixed solvent composition 5 contaminated by the cleaning of the article is caused to overflow into a right-hand tank, and at the same time, the article 9 is slowly pulled up to clean and dry it with vapor 3 vaporized from the mixed solvent compositions 4 and 5. The cleaned article is then taken out of the line.

The vapor 3 is condensed and liquefied by a condenser 1 in the same manner as the cleaning machine illustrated in FIG. 4 to reuse as in the embodiment shown in FIG. 4.

FIG. 6 illustrates an embodiment of a cleaning machine of batch-wise successive tanks. In this case, the apparatus includes one cleaning tank 6 filled with a routine cleaning liquid, three purging or rinsing tanks 7 filled with a routine purging or rinsing solvent, one cleaning tank 4 filled with the mixed solvent composition of this invention and one vapor cleaning (boiling) and drying tank 8.

In this apparatus, an article 9 to be cleaned is cleaned with the cleaning liquid in the cleaning tank 6. At this time, the cleaning liquid is purified by means of a pump P and a filter f to remove dust released in the cleaning liquid. The article 9 is then successively transferred to the three rinsing tanks 7 subsequent to the cleaning tank 6 and rinsed with the purging or rinsing solvent in the respective tanks. At this time, the purging or rinsing solvent is purified by means of a pump P and a filter f like the cleaning liquid to remove dust released in the rinsing solvent.

The finally-rinsed article (cleaned article) is sent to the vapor cleaning (boiling) and drying tank 8 to clean and dry it with vapor 3 vaporized from the mixed solvent composition of the present invention. The cleaned article is then taken out of the line.

The vapor 3 is condensed and liquefied by a condenser 1 in the same manner as the cleaning machine illustrated in FIG. 4 to reuse as in the embodiment shown in FIG. 4.

The present invention will hereinafter be described more specifically by the following Examples.

EXAMPLE 1:

One hundred milliliters of a mixture obtained by using 72% by weight (50% by volume) of Inert Fluid PF-5060 (product of Sumitomo 3M Limited) as perfluorohexane and adding 28% by weight (50% by volume) of isohexane (2-methylpentane) thereto were put in a distillation flask to conduct simple distillation.

As a result, a mixed solvent composition showing azeotropic behavior at 44.5° to 46° C. was distilled out. This fraction was analyzed by gas chromatography, and it was found that a compositional ratio of PF-5060 to isohexane is 77/23 (% by weight).

EXAMPLE 2:

One hundred milliliters of a mixture obtained by using 86% by weight (70% by volume) of Inert Fluid PF-5060 (product of Sumitomo 3M Limited) as perfluorohexane and adding 14% by weight (30% by volume) of isohexane (2-methylpentane) thereto were put in a distillation flask to conduct simple distillation.

As a result, a mixed solvent composition showing azeotropic behavior at 45° to 47° C. was distilled out. This fraction was analyzed by gas chromatography, and it was found that a compositional ratio of PF-5060 to isohexane is 80/20 (% by weight).

EXAMPLE 3:

One hundred milliliters of a mixture obtained by using 52% by weight (30% by volume) of Inert Fluid PF-5060 (product of Sumitomo 3M Limited) as perfluorohexane and adding 48% by weight (70% by volume) of isohexane (2-methylpentane) thereto were put in a distillation flask to conduct simple distillation.

As a result, a mixed solvent composition showing azeotropic behavior at 45° to 48° C. was distilled out. This fraction was analyzed by gas chromatography, and it was found that a compositional ratio of PF-5060 to isohexane is 74/26 (% by weight).

EXAMPLE 4:

One hundred milliliters of a mixture obtained by using 72% by weight (50% by-volume) of F Lead KPF-61 (product of Kanto Denka Kogyo Co., Ltd.) as perfluorohexane and adding 28% by weight (50% by volume) of isohexane (2-methylpentane) thereto were put in a distillation flask to conduct simple distillation.

As a result, a mixed solvent composition showing azeotropic behavior at 44° to 45° C. was distilled out. This fraction was analyzed by gas chromatography, and it was found that a compositional ratio of KPF-61 to isohexane is 78/22 (% by weight).

EXAMPLE 5:

One hundred milliliters of a mixture obtained by using 78.3% by weight (58.5% by volume) of Inert Fluid PF-5060 (product of Sumitomo 3M Limited) as perfluorohexane and adding 21.7% by weight (41.5% by volume) of isohexane (2-methylpentane) (product of Tokyo Kasei Kogyo Co., Ltd.) thereto were put in a distillation flask to conduct simple distillation.

As a result, a mixed solvent composition showing azeotropic behavior at 44° to 45° C. was distilled out. This fraction was analyzed by gas chromatography, and it was found that a compositional ratio of PF-5060 to isohexane is 78.3/21.7 (% by weight).

EXAMPLE 6:

One hundred milliliters of a mixture obtained by using 70% by weight (50% by volume) of Inert Fluid PF-5060 (product of Sumitomo 3M Limited) as perfluorohexane and adding 30% by weight (50% by volume) of diisopropyl ether thereto were put in a distillation flask to conduct simple distillation.

As a result, a mixed solvent composition showing azeotropic behavior at 47° to 51° C. was distilled out. This fraction was analyzed by gas chromatography, and it was found that a compositional ratio of PF-5060 to diisopropyl ether is 80/20 (% by weight).

EXAMPLE 7:

One hundred milliliters of a mixture obtained by using 81.8% by weight (66% by volume) of F Lead KPF-61 (product of Kanto Denka Kogyo Co., Ltd. ) as perfluorohexane and adding 18.2% by weight (34% by volume) of diisopropyl ether (product of Kishida Chemical Co., Ltd. ) thereto were put in a distillation flask to conduct simple distillation.

As a result, a mixed solvent composition showing azeotropic behavior at 48° to 49° C. was distilled out. This fraction was analyzed by gas chromatography, and it was found that a compositional ratio of KPF-61 to diisopropyl ether is 81.8/18.2 ( % by weight).

EXAMPLE 8:

A rust preventing oil (Polybutene LV-7, product of Nippon Petrochemicals Co., Ltd.) was selected as a model contaminant, and 10 μl of the rust preventing oil were dropped on a planished aluminum plate (25×7×5 mm), thereby providing a model for an article to be cleaned. Using the mixed solvent composition obtained by the simple distillation in Example 1 in all tanks of a cleaning tank, a purging or rinsing tank and a vapor cleaning (boiling) and drying tank as illustrated in FIG. 1, a cleaning experiment was conducted on the model by their corresponding cleaning means and under their corresponding cleaning conditions, both, shown in the following Table 1.

TABLE 1

| Kind of tank[1] | Cleaning tank | Purging or rising tank | Vapor cleaning[3] and drying tank |
|---|---|---|---|
| Solution in tank | PF-5060/isohexane = 77/23 (% by weight) | | |
| Cleaning means[2] | Ultrasonic | Ultrasonic | Vapor cleaning and drying |
| Temperature of solution (°C.) | 23 | 20 | Boiling (44–48) |
| Cleaning time (min) | 2 | 2 | 2 |
| Amount of solution (ml) | 180 | 180 | 70 |

[1]A 200-ml beaker made of Pyrex was used as each tank.
[2]Ultrasonic wave was generated at 28 kHz and 100 W.
[3]A cooling liquid for the condenser used in the vapor cleaning and drying tank was maintained at 20° C.

EXAMPLE 9:

A cleaning experiment was performed by means of exactly the same cleaning method and apparatus as in Example 8 except that the composition of Example 5 was used in all the tanks.

EXAMPLE 10:

A cleaning experiment was performed by means of exactly the same cleaning method and apparatus as in Example 8 except that the composition of Example 6 was used in all the tanks.

EXAMPLE 11:

A cleaning experiment was performed by means of exactly the same cleaning method and apparatus as in Example 8 except that the composition of Example 7 was used in all the tanks.

EXAMPLE 12:

A paraffin wax (Eprohon C-64, product of Nippon Kyokuatus Kagaku Kenkyusho) was selected as a model contaminant, and about 0.5 g of the paraffin wax was applied under heat to a slide glass (25×76×1 mm), thereby providing a model for an article to be cleaned.

According to a cleaning method in which two cleaning tanks, one purging or rinsing tank and one vapor cleaning (boiling) and drying tank were used, a cleaning experiment was conducted on the above article to be cleaned by using the composition of Example 5 as a purging or rinsing solvent and a vapor cleaning and drying solvent, and an aromatic solvent, Clean Sol G (product of Nippon Oil Co., Ltd.) as a cleaning solvent under their corresponding conditions and by their corresponding cleaning means, both, shown in the following Table 2.

TABLE 2

| Kind of[1] tank | Cleaning tank | Cleaning tank | Purging or rinsing tank | Vapor cleaning[3] and drying tank |
|---|---|---|---|---|
| Solution in tank | Clean Sol G | | PF-5060/isohexane = 78.3/21.7 (% by weight) | |
| Cleaning[2] means | Ultra-sonic | Ultra-sonic | Ultrasonic | Vapor cleaning and drying |
| Temp. of soln. (°C.) | 65–70 | 65–70 | 20 | Boiling (44–48) |
| Cleaning time (min) | 2 | 2 | 2 | 2 |
| Amount of soln. (ml) | 180 | 180 | 180 | 70 |

[1]A 200-ml beaker made of Pyrex was used as each tank.
[2]Ultrasonic wave was generated at 28 kHz and 100 W.
[3]A cooling liquid for the condenser used in the vapor cleaning and drying tank was maintained at 20° C.

EXAMPLE 13:

A cleaning experiment was performed by means of exactly the same cleaning method and apparatus as in Example 12 except that the composition of Example 7 was used in place of the composition of Example 5.

EXAMPLE 14:

A paraffin wax (Eprohon C-64, product of Nippon Kyokuatus Kagaku Kenkyusho) was selected as a model contaminant, and about 0.5 g of the paraffin wax was applied under heat to a piece (about 5×5×5 mm) of a magnetic head composed of a composite material of Permalloy, an epoxy resin and a zinc die-cast alloy, thereby providing a model for an article to be cleaned.

A cleaning experiment was performed by means of exactly the same cleaning method and apparatus as in Example 12 except for the article to be cleaned.

Figure 7:
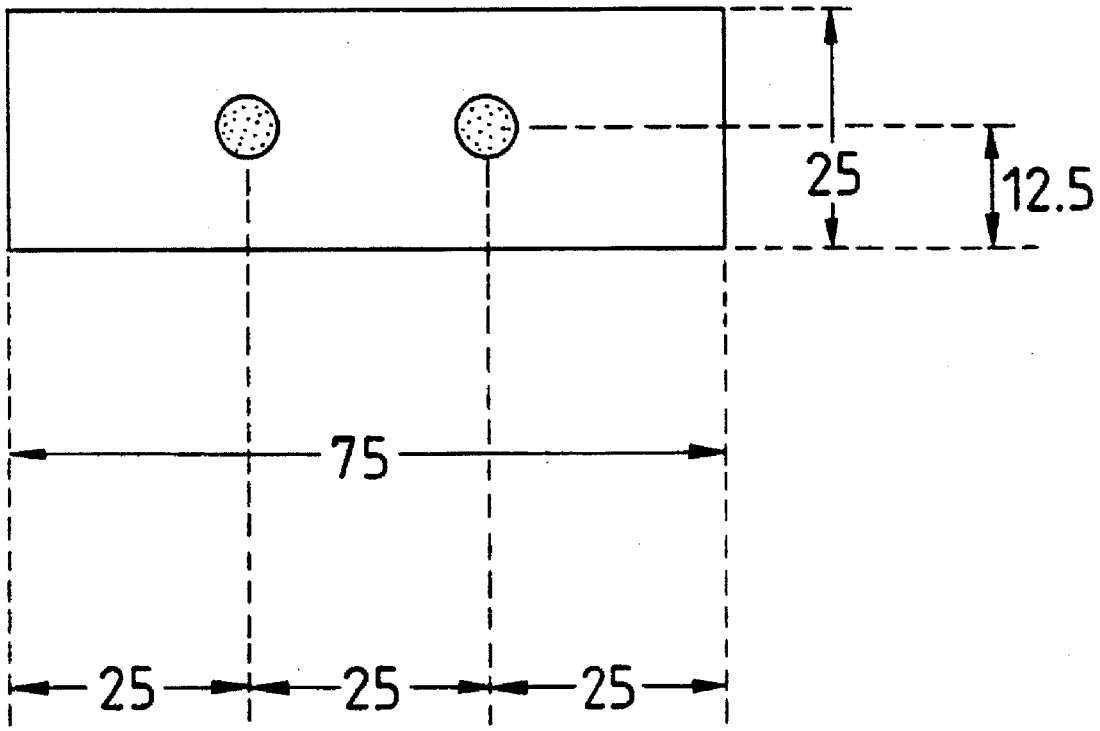
FIG. 7 illustrates a contaminated model article used in embodiments of the present invention.

EXAMPLE 15:

A metalworking oil (C107 Tapping Oil, product of Nippon Kosakuyu K.K.) was used as a model contaminant to tap two portions of a bonderized steel plate (25×75×1.5 mm) as illustrated in FIG. 7, thereby providing a model for an article to be cleaned.

Using the mixed solvent composition of Example 1 as all of a cleaning solution, a purging or rinsing solution and a vapor cleaning and drying solvent, a cleaning experiment was conducted on the model by a vacuum ultrasonic cleaner, F1 Clean YMV-452-EPZ Model (manufactured by Chiyoda Seisakusho K.K.) under their corresponding conditions shown in the following Table 3.

TABLE 3

| Kind of tank | Cleaning tank | Purging or rising tank | Vapor cleaning and drying tank |
|---|---|---|---|
| Solution in tank | PF-5060/isohexane = 78.3/21.7 (% by weight) | | |
| Cleaning means | Ultrasonic* | Ultrasonic* | Vapor cleaning |
| Temperature of solution (°C.) | 35 | 20 | Boiling (44–48) |
| Cleaning time (min) | 2 | 2 | 2 |

*Ultrasonic wave was generated at 28 kHz and 900 W.

COMPARATIVE EXAMPLE 1:

A cleaning experiment was performed by means of exactly the same cleaning method and apparatus as in Example 8 except that flon 113 was used in place of the composition of Example 1.

COMPARATIVE EXAMPLE 2:

A cleaning experiment was performed by means of exactly the same cleaning method and apparatus as in Comparative Example 1 except that flon **141*b* was used in place of flon 113**.

COMPARATIVE EXAMPLE 3:

A cleaning experiment was performed by means of exactly the same cleaning method and apparatus as in Comparative Example 1 except that flon 123 was used in place of flon 113.

COMPARATIVE EXAMPLE 4:

A cleaning experiment was performed by means of exactly the same cleaning method and apparatus as in Comparative Example 1 except that flon 225 was used in place of flon 113.

COMPARATIVE EXAMPLE 5:

A cleaning experiment was performed by means of exactly the same cleaning method and apparatus as in Comparative Example 1 except that trichloroethane was used in place of flon 113.

COMPARATIVE EXAMPLE 6:

A cleaning experiment was performed by means of exactly the same cleaning method and apparatus as in Example 12 except that IPA was used as a purging or rinsing solvent and a vapor cleaning and drying solvent.

COMPARATIVE EXAMPLE 7:

A cleaning experiment was performed by means of exactly the same cleaning method and apparatus as in Example 14 except that flon 113 was used as a cleaning solvent, a purging or rinsing solvent and a vapor cleaning and drying solvent.

COMPARATIVE EXAMPLE 8:

A cleaning experiment was performed by means of exactly the same cleaning method and apparatus as in Example 14 except that flon 225 (product of Asahi Glass Co., Ltd., a mixture of ca and cb) was used as a cleaning solvent, a purging or rinsing solvent and a vapor cleaning and drying solvent.

COMPARATIVE EXAMPLE 9:

A cleaning experiment was performed by means of exactly the same cleaning method and apparatus as in Example 15 except that methylene chloride was used in place of the composition of Example 5.

EVALUATION:

As described above, the mixed solvent compositions according to Examples 1 to 7 of the present invention, which have been obtained in the above-described manner, show azeotropic behavior of the minimum boiling point at a temperature lower than any boiling points (perfluorohexane: 58° to 60° C., isohexane: 62° C., diisopropyl ether: 68° C.) of the respective components. It is also understood that the percentage compositions of perfluorohexane contained in the compositions all fall within a range of from 70 to 85% by weight.

On respective compositions of this invention obtained in the same ways as in Examples 1 to 7 and composed of their corresponding two components and compositions shown in Table 4, flash point, tendency to attack plastics, vapor cleaning ability and ODP were evaluated in accordance with the following respective standards. The thus-obtained results are shown in Table 4 for the flash point and in Table 5 for the other properties.

For the sake of comparison, the various routine solvents hitherto used as vapor cleaning and drying solvents were also evaluated in the same items, and their results are also shown in Tables 4 and 5.

The evaluation was conducted in accordance with the following respective methods.

FLASH POINT:

The flash point of each test sample was measured by means of an automatic tag closed flash tester (ATG-4 model, manufactured by Tanaka Kagaku Kiki Seisaku K.K. ) in accordance with JIS K 2265.

TENDENCY TO ATTACK PLASTICS:

In order to confirm that the mixed solvent compositions according to the present invention do not have an adverse influence such as dissolution or swelling on commonly-used plastics, a swelling test was conducted. Commonly-used plastics of the following kinds were used as test pieces:

PMMA (acryl): Derpet 80N (product of Asahi Chemical Industry Co., Ltd.);

PC (polycarbonate): Panlight 1225 (product of Teijin Chemicals Ltd.);

ABS (acrylonitrile.butadiene.styrene copolymer): Cycolac EX120 (product of Ube Cycon, Ltd.);

POM (polyacetal): Duracon M90 (product of Polyplastics Co., Ltd. );

PS (polystyrene): HT53 (product of Idemitsu Petrochemical Co., Ltd.); and

Urethane rubber: Miractran E585 (Nippon Miractran K.K.).

The test was conducted by cutting each test piece into a size of 25×100 (mm) and heating each mixed solvent composition to vapor-clean the test piece for 3 minutes. The rate of weight change before and after vapor cleaning was determined to rank the mixed solvent composition in accordance with the following standard:

A: The rate was less than 0.1% by weight;

B: The rate was not less than 0.1% by weight, but less than 1% by weight;

C: The rate was not less than 1% by weight. ODP:

ODP is an abbreviation of Ozone Depletion Potential.

TABLE 4

| Ex. No. | Percentage composition of composition before and after distillation, and flash point: Percentage composition of composition (% by weight) Before distillation PFC | iHEX | IPE | After distillation PFC | iHEX | IPE | Flash point (°C.) |
|---|---|---|---|---|---|---|---|
| 1 | 72 | 28 | — | 77 | 23 | — | None |
| 2 | 86 | 14 | — | 80 | 20 | — | None |
| 3 | 52 | 48 | — | 74 | 26 | — | None |
| 4 | 72 | 28 | — | 78 | 22 | — | None |
| 5 | 78.3 | 21.7 | — | 78.3 | 21.7 | — | None |
| 6 | 70 | — | 30 | 80 | — | 20 | None |
| 7 | 81.8 | — | 18.2 | 81.8 | — | 18.2 | None |
| Routine solvents: | | | | Flon 113 | | | None |
| | | | | Flon 141b | | | None |
| | | | | Flon 123 | | | None |
| | | | | Flon 225 | | | None |
| | | | | Trichloroethane | | | None |
| | | | | Methylene chloride | | | None |
| | | | | IPA | | | 11 |

PFC: Perfluorohexane
iHEX: Isohexane
IPE: Diisopropyl ether

TABLE 5

Evaluation results (Examples 1 to 7 and routine solvents)

| Example No. | Tendency to attack plastics PMMA | PC | ABS | POM | PS | Urethane | ODP |
|---|---|---|---|---|---|---|---|
| 1 | A | A | A | A | A | A | 0 |
| 2 | A | A | A | A | A | A | 0 |
| 3 | A | A | A | A | A | A | 0 |
| 4 | A | A | A | A | A | A | 0 |
| 5 | A | A | A | A | A | A | 0 |
| 6 | A | A | A | A | A | A | 0 |
| 7 | A | A | A | A | A | A | 0 |
| Flon 113 | A | A | A | A | A | A | 0.8 |
| Flon 141b | C | C | C | C | C | C | 0.1 |
| Flon 123 | C | C | C | C | C | C | 0.02 |
| Flon 225 | C | A | B | A | A | C | 0.03 |
| Trichloroethane | C | C | C | C | C | C | 0.15 |
| Methylene chloride | C | C | C | C | C | C | 0.007 |
| IPA | B | A | A | A | A | C | 0 |

The cleaning ability where the mixed solvent compositions according to the present invention were used as practical cleaning solvents, vapor cleaning and drying solvents, and/or purging or rinsing solvents was then evaluated on Examples 8 to 15 and Comparative Examples 1 to 9. The results are shown in Table 6.

The evaluation was conducted as to contact angle, remaining amount of the contaminant and presence of a stain in accordance with the following respective methods:

CONTACT ANGLE:

The contact angle to purified water of a cleaned article on a plate after cleaned according to each of the examples and the comparative examples was measured at room temperature (22° to 25° C.) by means of a full automatic contact angle meter, CA-Z 150 Model manufactured by Kyowa Kaimenkagaku K.K. The unit is degree [°].

REMAINING AMOUNT OF CONTAMINANT

The articles cleaned according to the examples and the comparative examples, which the articles had been smeared with the paraffin wax as a contaminant, were separately immersed in 100 ml of toluene to extract the wax remaining on the articles by means of an ultrasonic cleaner (28 kHz, 100 W) for 30 minutes at 60° C. The resultant extracts were concentrated to about one-tenth by means of a rotary evaporator, and then subjected to quantitative determination by gas chromatography. The unit is μg/article.

STAIN:

The cleaning solvents used in the examples and the comparative examples were ranked as A where no stain remained on the surface of the article cleaned according to each of the examples and the comparative examples, as B where a stain somewhat remained, or C where a stain or oil film remained to a significant extent.

TABLE 6

Evaluation results in Examples 8 to 15 and Comparative Examples 1 to 9

| Ex. | Contact angle [°] | Stain | Remaining amount of conta. [μg/art] | Comp. Ex. | Contact angle [°] | Stain | Remaining amount of conta. [μg/art] |
|---|---|---|---|---|---|---|---|
| 8 | <5 | A | — | 1 | <5 | A | — |
| 9 | <5 | A | — | 2 | <5 | A | — |
| 10 | <5 | A | — | 3 | <5 | A | — |
| 11 | <5 | A | — | 4 | <5 | A | — |
| | | | | 5 | 8 | A | — |
| 12 | 8 | A | 25 | 6 | 21 | B | 78 |
| 13 | 9 | A | 25 | | | | |

TABLE 6-continued

| Evaluation results in Examples 8 to 15 and Comparative Examples 1 to 9 | | | | | | | |
|---|---|---|---|---|---|---|---|
| Ex. | Contact angle [°] | Stain | Remaining amount of conta. [μg/art] | Comp. Ex. | Contact angle [°] | Stain | Remaining amount of conta. [μg/art] |
| 14 | — | A | 10 | 7 | — | A | 30 |
| | | | | 8 | — | A | 60 |
| 15 | <5 | A | — | 9 | 10 | B | — |

EXAMPLE 16:

In a fractionating column equipped with a Widmer spiral (200 mm), 120 ml of a mixture composed of the following components were simply destilled:

| | |
|---|---|
| Inert Fluid PF-5060 (product of Sumitomo 3M Limited) | 47.6% by weight (33.3% by volume) |
| Ethyl trifluoroacetate (product of PCR Company) | 33.8% by weight (33.3% by volume) |
| Isohexane (2-methylpentane) (product of Tokyo Kasei Kogyo Co., Ltd.) | 18.6% by weight (33.3% by volume) |

As the result of the simple distillation, a fraction showing azeotropic behavior at 43.5° to 44.0° C. was distilled out. This fraction was analyzed by gas chromatography and was found to contain the respective components at the following percentage composition.

| | |
|---|---|
| PF-5060 | 65.2% by weight |
| Ethyl trifluoroacetate | 19.2% by weight |
| Isohexane | 15.6% by weight |

EXAMPLE 17:

In a fractionating column equipped with a Widmer spiral (200 mm), 120 ml of a mixture composed of the following components were simply distilled:

| | |
|---|---|
| Inert Fluid PF-5060 (product of Sumitomo 3M Limited) | 64.5% by weight (50.0% by volume) |
| Ethyl trifluoroacetate (product of PCR Company) | 22.9% by weight (25.0% by volume) |
| Isohexane (2-methylpentane) (product of Tokyo Kasei Kogyo Co., Ltd.) | 12.6% by weight (25.0% by volume) |

As the result of the simple distillation, a fraction showing azeotropic behavior at 42° to 44.0° C. was distilled out. This fraction was analyzed by gas chromatography and was found to contain the respective components at the following percentage composition.

| | |
|---|---|
| PF-5060 | 66.3% by weight |
| Ethyl trifluoroacetate | 18.9% by weight |
| Isohexane | 14.8% by weight |

EXAMPLE 18:

In a fractionating column equipped with a Widmer spiral (200 mm), 120 ml of a mixture composed of the following components were simply distilled:

| | |
|---|---|
| Inert Fluid PF-5060 (product of Sumitomo 3M Limited) | 35.6% by weight (25.0% by volume) |
| Ethyl trifluoroacetate (product of PCR Company) | 50.5% by weight (50.0% by volume) |
| Isohexane (2-methylpentane) (product of Tokyo Kasei Kogyo Co., Ltd.) | 13.9% by weight (25.0% by volume) |

As the result of the simple distillation, a fraction showing azeotropic behavior at 43° to 45° C. was distilled out. This fraction was analyzed by gas chromatography and was found to contain the respective components at the following percentage composition.

| | |
|---|---|
| PF-5060 | 64.5% by weight |
| Ethyl trifluoroacetate | 19.8% by weight |
| Isohexane | 15.7% by weight |

EXAMPLE 19:

In a fractionating column equipped with a Widmer spiral (200 mm), 120 ml of a mixture composed of the following components were simply distilled:

| | |
|---|---|
| Inert Fluid PF-5060 (product of Sumitomo 3M Limited) | 40.2% by weight (25.0% by volume) |
| Ethyl trifluoroacetate (product of PCR Company) | 28.5% by weight (25.0% by volume) |
| Isohexane (2-methylpentane) (product of Tokyo Kasei Kogyo Co., Ltd.) | 31.3% by weight (50.0% by volume) |

As the result of the simple distillation, a fraction showing azeotropic behavior at 43° to 46° C. was distilled out. This fraction was analyzed by gas chromatography and was found to contain the respective components at the following percentage composition.

| | |
|---|---|
| PF-5060 | 63.0% by weight |
| Ethyl trifluoroacetate | 18.8% by weight |
| Isohexane | 18.2% by weight |

EXAMPLE 20:

In a fractionating column equipped with a Widmer spiral (200 mm), 120 ml of a mixture composed of the following components were simply distilled:

| | |
|---|---|
| F Lead KPF-61 (product of Kanto Denka Kogyo Co., Ltd.) | 65.0% by weight (48.7% by volume) |

-continued

| | |
|---|---|
| Ethyl trifluoroacetate (product of PCR Company) | 19.0% by weight (20.2% by volume) |
| Isohexane (2-methylpentane) (product of Tokyo Kasei Kogyo Co., Ltd.) | 16.0% by weight (31.1% by volume) |

As the result of the simple distillation, substantially the whole amount of the mixture was distilled out as a fraction showing azeotropic behavior at 43.8° C. This fraction was analyzed by gas chromatography and was found to contain the respective components at the following percentage composition.

| | |
|---|---|
| KPF-61 | 65.0% by weight |
| Ethyl trifluoroacetate | 19.0% by weight |
| Isohexane | 16.0% by weight |

EXAMPLE 21:

In a fractionating column equipped with a Widmer spiral (200 mm), 120 ml of a mixture composed of the following components were simply distilled:

| | |
|---|---|
| Inert Fluid PF-5060 (product of Sumitomo 3M Limited) | 65.0% by weight (49.3% by volume) |
| Ethyl trifluoroacetate (product of PCR Company) | 19.0% by weight (20.5% by volume) |
| Isohexane (2-methylpentane) (product of Tokyo Kasei Kogyo Co., Ltd.) | 16.0% by weight (30.2% by volume) |

As the result of the simple distillation, a fraction showing azeotropic behavior at 43.5° to 44.0° C. was distilled out. This fraction was analyzed by gas chromatography and was found to contain the respective components at the following percentage composition.

| | |
|---|---|
| PF-5060 | 65.2% by weight |
| Ethyl trifluoroacetate | 19.2% by weight |
| Isohexane | 15.6% by weight |

EXAMPLE 22:

A rust preventing oil (Polybutene LV-7, product of Nippon Petrochemicals Co., Ltd.) was selected as a model contaminant, and 10 μl of the rust preventing oil were dropped on a planished aluminum plate (25×76×5 mm), thereby providing a model for an article to be cleaned.

Using the mixed solvent composition obtained by the simple distillation in Example 16 in all tanks of a cleaning tank, a purging or rinsing tank and a vapor cleaning and drying tank as illustrated in FIG. 1, a cleaning experiment was conducted on the model by their corresponding cleaning means and under their corresponding cleaning conditions, both, shown in the following Table 7.

TABLE 7

| Kind of tank[1] | Cleaning tank | Purging or rising tank | Vapor cleaning[3] and drying tank |
|---|---|---|---|
| Solution in tank | PF-5060/ethyl trifluoroacetate/isohexane = 65.2/19.2/15.6 (% by weight) | | |
| Cleaning means[2] | Ultrasonic | Ultrasonic | Vapor cleaning and drying |
| Temperature of solution (°C.) | 23 | 20 | Boiling (42–46) |
| Cleaning time (min) | 2 | 2 | 2 |
| Amount of solution (ml) | 180 | 180 | 70 |

[1]A 200-ml beaker made of Pyrex was used as each tank.
[2]Ultrasonic wave was generated at 28 kHz and 100 W.
[3]A cooling liquid for the condenser used in the vapor cleaning and drying tank was maintained at 20° C.

EXAMPLE 23:

A cleaning experiment was performed by means of exactly the same cleaning method and apparatus as in Example 22 except that the composition of Example 20 was used in all the tanks.

EXAMPLE 24:

A cleaning experiment was performed by means of exactly the same cleaning method and apparatus as in Example 22 except that the composition of Example 21 was used in all the tanks.

EXAMPLE 25:

A paraffin wax (Aprofon C-64, product of Nippon Kyokuatus Kagaku Kenkyusho) was selected as a model contaminant, and about 0.5 g of the paraffin wax was applied under heat to a slide glass (25×76×1 mm), thereby providing a model for an article to be cleaned.

Using the above article to be cleaned, a cleaning experiment was conducted in a cleaning apparatus comprising two cleaning tanks, one purging or rinsing tank and one vapor cleaning and drying tank by using the composition obtained in Example 21 as a purging or rinsing solvent and a vapor cleaning and drying solvent, and an aromatic solvent, Clean Sol G (product of Nippon Oil Co., Ltd.) as a cleaning solvent under their corresponding conditions and by their corresponding cleaning means, both, shown in the following Table 8.

TABLE 8

| Kind of[1] tank | Cleaning tank | Cleaning tank | Purging or rinsing tank | Vapor cleaning[3] and drying tank |
|---|---|---|---|---|
| Solution in tank | Clean Sol G | | PF-5060/ethyl trifluoroacetate/isohexane = 65.2/19.2/15.6 (% by weight) | |
| Cleaning[2] means | Ultrasonic | Ultrasonic | Ultrasonic | Vapor cleaning and drying |
| Temp. of soln. (°C.) | 65–70 | 65–70 | 20 | Boiling (42–46) |
| Cleaning time (min) | 2 | 2 | 2 | 2 |
| Amount of soln. (ml) | 180 | 180 | 180 | 70 |

[1]A 200-ml beaker made of Pyrex was used as each tank.
[2]Ultrasonic wave was generated at 28 kHz and 100 W.
[3]A cooling liquid for the condenser used in the vapor cleaning and drying tank was maintained at 20° C.

EXAMPLE 26:

A cleaning experiment was performed by means of exactly the same cleaning method and apparatus as in Example 25 except that the composition of Example 20 was used as a purging or rinsing solvent and a vapor cleaning and drying solvent.

EXAMPLE 27:

A paraffin wax (Aprofon C-64, product of Nippon Kyokuatus Kagaku Kenkyusho) was selected as a model contaminant, and about 0.5 g of the paraffin wax was applied under heat to a piece (about 5×5×5 mm) of a magnetic head composed of a composite material of Permalloy, an epoxy resin and a zinc die-cast alloy, thereby providing a model for an article to be cleaned.

A cleaning experiment was performed by means of exactly the same cleaning method and apparatus as in Example 25 except for the above article to be cleaned.

EXAMPLE 28:

A metalworking oil (C107 Tapping Oil, product of Nippon Kosakuyu K.K.) was used as a model contaminant to tap two portions of a bonderized steel plate (25×75×1.5 mm) as illustrated in FIG. 7, thereby providing a model for an article to be cleaned.

Using the mixed solvent composition obtained in Example 21 as all of a cleaning solution, a purging or rinsing solution and a vapor cleaning and drying solvent, a cleaning experiment was conducted on the model by a vacuum ultrasonic cleaner, F1 Clean YMV-452-EPZ Model (manufactured by Chiyoda Seisakusho K.K.) under the following conditions:

| | |
|---|---|
| Hot solution cleaning: | 35° C., 2 minutes, ultrasonic wave (28 kHz, 900 W); |
| Cold solution cleaning: | 20° C., 2 minutes, ultrasonic wave (28 kHz, 900 W); and |
| Vapor cleaning: | 2 minutes. |

COMPARATIVE EXAMPLE 10:

A cleaning experiment was performed by means of exactly the same cleaning method and apparatus as in Example 22 except that flon 113 was used in place of the composition of Example 16.

COMPARATIVE EXAMPLE 11:

A cleaning experiment was performed by means of exactly the same cleaning method and apparatus as in Example 22 except that flon **141*b*** was used in place of the mixed solvent composition.

COMPARATIVE EXAMPLE 12:

A cleaning experiment was performed by means of exactly the same cleaning method and apparatus as in Example 22 except that flon 123 was used in place of the mixed solvent composition.

COMPARATIVE EXAMPLE 13:

A cleaning experiment was performed by means of exactly the same cleaning method and apparatus as in Example 22 except that flon 225 was used in place of the mixed solvent composition.

COMPARATIVE EXAMPLE 14:

A cleaning experiment was performed by means of exactly the same cleaning method and apparatus as in Example 22 except that trichloroethane was used in place of the mixed solvent composition.

COMPARATIVE EXAMPLE 15:

A cleaning experiment was performed by means of exactly the same cleaning method and apparatus as in Example 22 except that methylene chloride was used in place of the mixed solvent composition.

COMPARATIVE EXAMPLE 16:

A cleaning experiment was performed by means of exactly the same cleaning method and apparatus as in Example 25 except that IPA was used as a purging or rinsing solvent and a vapor cleaning and drying solvent.

COMPARATIVE EXAMPLE 17:

A cleaning experiment was performed by means of exactly the same cleaning method and apparatus as in Example 27 except that flon 113 was used as a cleaning solvent, a purging or rinsing solvent and a vapor cleaning and drying solvent.

COMPARATIVE EXAMPLE 18:

A cleaning experiment was performed by means of exactly the same cleaning method and apparatus as in Example 27 except that flon 225 (product of Asahi Glass Co., Ltd., a mixture of ca and cb) was used as a cleaning solvent, a purging or rinsing solvent and a vapor cleaning and drying solvent.

COMPARATIVE EXAMPLE 19:

A cleaning experiment was performed by means of exactly the same cleaning method and apparatus as in Example 28 except that methylene chloride was used in place of the mixed solvent composition.

COMPARATIVE EXAMPLE 20:

A cleaning experiment was performed by means of exactly the same cleaning method and apparatus as in Example 28 except that 1,1,1-trichloroethane was used in place of the mixed solvent composition.

As described above in Examples 16 to 21, the mixed solvent compositions according to the present invention show azeotropic behavior of the minimum boiling point at a temperature lower than any boiling points (perfluorohexane: 58° to 60° C., isohexane: 62° C., ethyl trifluoroacetate: 60° to 62° C., isohexane: 62° C.) of the respective components. In these compositions, the percentage compositions of perfluorohexane all fall within a range of from 61 to 69% by weight (see Table 9). As the fundamental properties of these mixed solvent composition, their flash points, tendency to attack plastics, ODP and phase separation temperatures were compared with those of organochlorine solvents routinely used. The results are shown in Table 10.

The respective evaluation tests were conducted in the following ways.

FLASH POINT:

The test was conducted in the same manner as described above.

TENDENCY TO ATTACH PLASTICS:

The test was conducted in the same manner as described above.

ODP:

ODP is an abbreviation of Ozone Depletion Potential.

PHASE SEPARATION TEMPERATURE:

In order to test the stability of the mixed solvent compositions, each of the solvent compositions according to Examples 16 to 21 and Comparative Examples 10 to 11 was put into a 50-ml sample tube equipped with a magnetic stirrer and a thermometer. The sample tube was then immersed in a dry ice-acetone bath to cool the contents to −78° C. Thereafter, the sample tube was taken out in an atmosphere at room temperature to determine a temperature at which a heterogeneous phase separated due to agitation at about 1,000 rpm by the magnetic stirrer to become opaque turned into a transparent homogeneous phase. Such a temperature was regarded as a phase separation temperature.

TABLE 9

| Ex. No. | Percentage composition of composition before and after distillation, and flash point: Percentage composition of composition (% by weight) Before distillation PFC | ETFA | iHEX | After distillation PFC | ETFA | iHEX | Flash point (°C.) |
|---|---|---|---|---|---|---|---|
| 16 | 47.6 | 33.8 | 18.6 | 65.2 | 19.2 | 15.6 | None |
| 17 | 64.5 | 22.9 | 12.6 | 66.3 | 18.9 | 14.8 | None |
| 18 | 35.6 | 50.5 | 13.9 | 64.5 | 19.8 | 15.7 | None |
| 19 | 40.2 | 28.5 | 31.3 | 64.7 | 19.1 | 16.2 | None |
| 20 | 65.0 | 19.0 | 16.0 | 65.0 | 19.0 | 16.0 | None |
| 21 | 6.50 | 19.0 | 16.0 | 65.2 | 19.2 | 15.6 | None |
| Routine solvents: | | | | Flon 113 | | | None |
| | | | | Flon 141b | | | None |
| | | | | Flon 123 | | | None |
| | | | | Flon 225 | | | None |
| | | | | Trichloroethane | | | None |
| | | | | Methylene chloride | | | None |
| | | | | IPE | | | 11 |

PFC: Perfluorohexane
ETFA: Ethyl trifluoroacetate
iHEX: Isohexane

TABLE 10

| Example No. | Evaluation results: Tendency to attack plastics PMMA | PC | ABS | POM | PS | Urethane | ODP | Phase separation temp. (°C.) |
|---|---|---|---|---|---|---|---|---|
| 16 | A | A | A | A | A | A | 0 | <−20 |
| 17 | A | A | A | A | A | A | 0 | <−20 |
| 18 | A | A | A | A | A | A | 0 | <−20 |
| 19 | A | A | A | A | A | A | 0 | <−20 |
| 20 | A | A | A | A | A | A | 0 | <−20 |
| 21 | A | A | A | A | A | A | 0 | <−20 |
| Flon 113 | A | A | A | A | A | A | 0.8 | N/A |
| Flon 141b | C | C | C | C | C | C | 0.1 | N/A |
| Flon 123 | C | C | C | C | C | C | 0.02 | N/A |
| Flon 225 | C | A | B | A | A | C | 0.03 | N/A |
| Trichloroethane | C | C | C | C | C | C | 0.15 | N/A |
| Methylene chloride | C | C | C | C | C | C | 0.007 | N/A |
| IPA | B | A | A | A | A | C | 0 | N/A |

The cleaning ability where the mixed solvent compositions according to the present invention were used as practical cleaning solvents, vapor cleaning and drying solvents, and/or purging or rinsing solvents was then evaluated on Examples 22 to 28 and Comparative Examples 10 to 20. The results are shown in Table 11.

The evaluation was conducted as to contact angle, remaining amount of the contaminant and presence of stain in the same manner as described above.

TABLE 11

| Evaluation results in Examples 22 to 28 and Comparative Examples 10 to 20 | | | | | | | |
|---|---|---|---|---|---|---|---|
| Ex. | Contact angle [°] | Stain | Remaining amount of conta. [μg/art] | Comp. Ex. | Contact angle [°] | Stain | Remaining amount of conta. [μg/art] |
| 22 | <5 | A | — | 10 | <5 | A | — |
| 23 | <5 | A | — | 11 | <5 | A | — |
| 24 | <5 | A | — | 12 | <5 | A | — |
| | | | | 13 | <5 | A | — |
| | | | | 14 | 8 | B | — |
| | | | | 15 | 6 | B | — |
| 25 | 8 | A | 20 | 16 | 21 | B | 78 |
| 26 | 9 | A | 20 | | | | |
| 27 | — | A | 15 | 17 | — | A | 30 |
| | | | | 18 | — | A | 60 |
| 28 | <5 | A | — | 19 | 10 | B | — |
| | | | | 20 | 8 | A | — |

As described above, the mixed solvent compositions according to the present invention have no flash point owing to their well-balanced compositions showing azeotropic behavior and show little tendency to attack plastics. Therefore, they can replace organochlorine solvents including flon 113 and be used as vapor cleaning and drying solvents.

Moreover, the mixed solvent compositions according to the present invention contain no chlorine atom and hence have no ozone depletion potential, so that they involve no problem of ozonosphere destruction.

Further, since the mixed solvent compositions according to the present invention have no flash point owing to their well-balanced compositions showing azeotropic behavior, they can be used as vapor cleaning and drying solvents instead of 1,1,1-trichloroethane, methylene chloride and the like. They can also be satisfactorily put to good use as various cleaning solvents and diluents because they have cleaning ability and finishing behavior equal to the routine cleaning solvents such as those described in the comparative examples.

What is claimed is:

1. A cleaning method including the steps of cleaning an article with a solvent, optionally purging or rinsing said article with a solvent, and cleaning and drying said article with solvent vapor, wherein the solvent in any one of the steps is the same as or different from the solvent in any or all of the other steps, and wherein the solvent in at least one of the steps is a mixed solvent composition consisting essentially of 70–85% by weight of perfluoro-n-hexane and 15 to 30% by weight of isohexane, said composition having an azeotropic boiling point of 44° to 48° C. at ambient pressure.

2. A cleaning method according to claim 1, wherein the composition contains perfluoropentane, perfluoroheptane and perfluorocyclohexane as impurities.

3. A cleaning method according to claim 1, wherein the composition contains n-paraffins and cycloparaffins as impurities.

4. A cleaning method including the steps of cleaning an article with a solvent, optionally purging or rinsing said article with a solvent, and cleaning and drying said article with solvent vapor, wherein the solvent in any one of the steps is the same as or different from the solvent in any or all of the other steps, and wherein the solvent in at least one of the steps is a mixed solvent composition consisting essentially of 70 to 85% by weight of perfluoro-n-hexane and 15 to 30% by weight of diisopropyl ether, said composition having an azeotropic boiling point of 47° to 51° C. at ambient pressure.

5. A cleaning method according to claim 4, wherein the composition contains perfluoropentane, perfluoroheptane and perfluorocyclohexane as impurities.

6. A cleaning method according to claim 4, wherein the composition contains n-paraffins and cycloparaffins as impurities.

7. A cleaning method including the steps of cleaning an article with a solvent, optionally purging or rinsing said article with a solvent, and cleaning and drying said article with solvent vapor, wherein the solvent in any one of the steps is the same as or different from the solvent in any or all of the other steps, and wherein the solvent in at least one of the steps is a mixed solvent composition consisting essentially of 60–70% by weight of perfluoro-n-hexane, 14 to 20% by weight of isohexane and 15 to 21% by weight of ethyltrichloroacetate, said composition having an azeotropic boiling point of 42° to 46° C. at ambient pressure.

8. A cleaning method according to claim 7, wherein the composition contains perfluoropentane, perfluoroheptane and perfluorocyclohexane as impurities.

9. A cleaning method according to claim 7, wherein the composition contains n-paraffins and cycloparaffins as impurities.

10. A cleaning apparatus including at least one cleaning tank, optionally a purging or rinsing tank, and a vapor cleaning and drying tank, wherein each tank is disposed in a lateral arrangement, wherein at least one of the tanks contains a mixed solvent composition consisting essentially of 70–85% by weight of perfluoro-n-hexane and 15–30% by weight of isohexane, said composition having an azeotropic boiling point of 44°–48° C. at ambient pressure.

11. A cleaning apparatus according to claim 10, wherein the composition contains perfluoropentane, perfluoroheptane and perfluorocyclohexane as impurities.

12. A cleaning apparatus according to claim 10, wherein the composition contains n-paraffins and cycloparaffins as impurities.

13. A cleaning apparatus including at least one cleaning tank, optionally a purging or rinsing tank, and a vapor cleaning and drying tank, wherein each tank is disposed in a lateral arrangement, wherein at least one of the tanks contains a mixed solvent composition consisting essentially of 70–85% by weight of perfluoro-n-hexane and 15–30% by weight of diisopropyl ether, said composition having an azeotropic boiling point of 47°–51° C. at ambient pressure.

14. A cleaning apparatus according to claim 13, wherein the composition contains perfluoropentane, perfluorohexane and perfluorocyclohexane as impurities.

15. A cleaning apparatus according to claim 13, wherein the composition contains n-paraffins and cycloparaffins as impurities.

16. A cleaning apparatus including at least one cleaning tank, optionally a purging or rinsing tank, and a vapor cleaning and drying tank, wherein each tank is disposed in a lateral arrangement, wherein at least one of the tanks contains a mixed solvent composition consisting essentially of 60–70% by weight of perfluoro-n-hexane, 14 to 20% by weight of isohexane and 15–21% by weight of ethyltrichloroacetate, said composition having an azeotropic boiling point of 42°–46° C. at ambient pressure.

17. A cleaning apparatus according to claim 16, wherein the composition contains perfluoropentane, perfluoroheptane and perfluorocyclohexane as impurities.

18. A cleaning apparatus according to claim 16, wherein the composition contains n-paraffins and cycloparaffins as impurities.

* * * * *

UNITED STATES PATENT AND TRADEMARK OFFICE

CERTIFICATE OF CORRECTION

PATENT NO. : 5,490,894

DATED : February 13, 1996

INVENTOR(S) : HIROHIDE MATSUHISA ET AL.

It is certified that error appears in the above-identified patent and that said Letters Patent is hereby corrected as shown below:

On the title page,

AT [56] REFERENCES CITED

Foregin Patent Documents,
"5214324" should read --5-214324--.
"5293303" should read --5-293303--.

Other Publications, under Stiles et al.,
"Perfluror-2-methylpentane" should read
--Perfluoro-2-methylpentane--.

COLUMN 1

Line 43, "sum there," should read --sun,--.
Line 51, "sharpely" should read --sharply--.
Line 52, "unsparingly" should read --sharply--.

COLUMN 2

Line 2, "85" should read --85%--.
Line 23, "fourth" should read --the fourth--.

COLUMN 4

Line 16, "Limited)" should read --Limited),--.
Line 17, "," should be deleted.
Line 47, "However," should read --¶ However,--.
Line 56, "step it" should read --step, it--.

UNITED STATES PATENT AND TRADEMARK OFFICE

CERTIFICATE OF CORRECTION

PATENT NO. : 5,490,894

DATED : February 13, 1996

INVENTOR(S) : HIROHIDE MATSUHISA ET AL.

It is certified that error appears in the above-identified patent and that said Letters Patent is hereby corrected as shown below:

COLUMN 5

Line 11, "is" should be deleted.
Line 15, "been" should read --been used--.

COLUMN 8

Line 12, "by-volume)" should read --by volume)--.

COLUMN 9

Line 5, "(25x7x5 mm)," should read --(25x76x5mm),--.
Line 6, "Using" should read --¶ Using--.
Line 13, "both," should read --both--.
Line 66, "both," should read --both--.

COLUMN 12

Line 65, "ODP:" should read --¶ ODP:--.

COLUMN 14

Line 18, "cleaned" should read --being cleaned--.
Line 30, "which" should read --in which--.
Line 49, "a stain somewhat" should read --somewhat of a stain--.

COLUMN 17

Line 58, "both," should read --both--.

UNITED STATES PATENT AND TRADEMARK OFFICE

CERTIFICATE OF CORRECTION

PATENT NO. : 5,490,894

DATED : February 13, 1996

INVENTOR(S) : HIROHIDE MATSUHISA ET AL. Page 3 of 3

It is certified that error appears in the above-identified patent and that said Letters Patent is hereby corrected as shown below:

COLUMN 18

Line 41, "both," should read --both--.

COLUMN 20

Line 52, "composition," should read --compositions,--.
Line 64, "ATTACH" should read --ATTACK--.

COLUMN 21

Line 8, "11" should read --20--.

Signed and Sealed this

Seventeenth Day of September, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,490,894

DATED : February 13, 1996

INVENTOR(S) : HIROHIDE MATSUHISA, ET AL.

It is certified that error appears in the above-identified patent and that said Letters Patent is hereby corrected as shown below:

COLUMN 24

Line 45, "ethyltrichloroacetate" should read --ethyl trifluoroacetate--.

COLUMN 26

Line 5, "ethyltrichloroacetate" should read --ethyl trifluoroacetate--.

Signed and Sealed this

Twenty-eighth Day of September, 1999

*Attest:*

Q. TODD DICKINSON

*Attesting Officer*

*Acting Commissioner of Patents and Trademarks*